United States Patent [19]

Lepisto

[11] Patent Number: 4,550,442

[45] Date of Patent: Oct. 29, 1985

[54] MULTIWALL GUSSETTED BAG WITH SEAMLESS TUBULAR LINER

[75] Inventor: J. George Lepisto, Middletown, Ohio

[73] Assignee: Champion International Corporation, Stamford, Conn.

[21] Appl. No.: 615,573

[22] Filed: May 31, 1984

[51] Int. Cl.[4] ..... B65D 33/02; B65D 30/20

[52] U.S. Cl. ..... 383/113; 383/120

[58] Field of Search ..... 383/109, 120, 118, 113, 383/111, 105, 112, 116, 119

[56] References Cited

U.S. PATENT DOCUMENTS

| | | | |
|---|---|---|---|
| 1,948,569 | 2/1934 | Falk | 383/120 X |
| 3,035,754 | 5/1962 | Meister | 383/120 |
| 3,235,168 | 2/1966 | Nichols | 383/120 X |
| 3,291,375 | 12/1966 | Lepisto | 383/120 X |
| 3,305,160 | 2/1967 | Lehman | 383/113 X |
| 3,473,724 | 10/1969 | Coverstone et al. | 383/109 |
| 3,927,825 | 12/1975 | Stearley | 383/113 X |
| 3,929,275 | 12/1970 | Bolling et al. | 383/111 |
| 3,958,749 | 5/1976 | Goodrich | 383/111 X |
| 4,088,264 | 5/1978 | Vogt | 383/111 |
| 4,174,804 | 11/1979 | Bosse | 383/109 |

FOREIGN PATENT DOCUMENTS

| | | | |
|---|---|---|---|
| 130910 | 3/1929 | Switzerland | 383/120 |
| 1074712 | 7/1967 | United Kingdom | 383/120 |

*Primary Examiner*—William Price
*Assistant Examiner*—Sue A. Weaver
*Attorney, Agent, or Firm*—Evelyn M. Sommer; William W. Jones

[57] ABSTRACT

A multiwall gussetted bag of the type having pinch bottom and pinch top closures is provided with a seamless plastic liner. The liner is gussetted and one-half of each of the gussets of the liner nests inside of the corresponding gusset half of the remaining bag layers, while the other half of each of the gussets extends inwardly toward the middle of the bag and does not nest with the corresponding gusset half of the remainder of the bag. This condition is present while the bag is empty. When the bag is filled, the non-nesting liner gusset halves are expanded by internal pressure resulting from filling the bag with the product into nesting relationship with the corresponding gusset halves on the remainder of the bag.

5 Claims, 5 Drawing Figures

MULTIWALL GUSSETTED BAG WITH SEAMLESS TUBULAR LINER

This invention relates to a multiwall bag of the type having side gussets and top and bottom pinch type closures. More particularly, this invention relates to such a bag which includes a seamless tubular liner having side gussets.

It is known to form multiwall pinch closure bags with side gussets and plastic liners. Such a bag is disclosed generally in U.S. Pat. No. 4,088,264, issued May 9, 1978 to R. C. Vogt. Bags of this type may be formed with a seamed plastic liner as disclosed in the aforesaid U.S. Pat. No. 4,088,264, or may be formed with a seamless plastic liner as disclosed in U.S. Pat. No. 3,291,375, issued Dec. 13, 1966 to J. G. Lepisto. In packaging some products, a seamless plastic liner is highly preferred since such products may actually attack the adhesives used to form the seam in the liner and cause the seam to open.

When the bags are formed with a seamed plastic liner, the liner and all of the other layers are formed from stock sheet material which is fed from rolls onto a scoring and seaming machine. Each layer is folded to form the side gussets, with the gussets of each layer being folded into nesting relationship with the corresponding gussets in the next inner layer. Each layer is separately seamed, and the layers are usually joined to each other by adhesive spots. In this manner, each of the layers will have gussets which nest with each of the other layers.

When the bags are formed with a seamless tubular plastic liner, the gussetted tubular plastic liner is fed into the scoring and seaming machine where the outer layers are progressively scored and seamed over the tubular plastic liner. These outer layers can have their gusset folds formed in a nesting fashion, however, the gussets of the outer layers will not nest with the gussets in the liner. In order to provide nesting of the liner gussets with the outer layer gussets, an air bubble has been introduced into the liner so as to inflate the liner and the outer layers with air. This inflation causes the liner gussets to expand into the outer layer gussets so that when the air bubble is removed, the gussets will remain nested. This procedure is disclosed in the Lepisto U.S. Pat. No. 3,291,375 patent referenced above. The ability of the liner to retain an air bubble is created by spaced pairs of rollers on the forming machine. This procedure is acceptable when the stock bag materials are in a longitudinally continuous form and are capable of remaining inflated anywhere along their length. In such a case, the stock laminated and gussetted material will be cut to length after being processed on the machine. In some machines, however, the stock material is laterally perforated during processing so that the individual bags can be torn off of the continuous laminated stock material via the perforations. These perforations will not allow the sustaining of the air bubble during bag manufacture, thus, this type of bag manufacture could not be practiced with a seamless plastic tubular liner with the teachings of the prior art.

This invention relates to a multiwall gussetted bag which has a seamless plastic tubular liner which will have nested gussets when filled with product and which can be made by periodically perforated stock material. The seamless plastic tubular liner is formed with staggered gusset components wherein one-half of the gusset is formed in the normal outwardly projecting fashion, and the other half of the gusset is formed in an inwardly projecting fashion. A fold line is disposed between the outwardly and inwardly projecting gusset halves. The liner, thus gussetted, is fed into the scoring and seaming machine wherein the outer gussetted layers are progressively formed on the bag. When the gussets on the outer layers are formed, the outwardly projecting gusset half on the liner will nest into a corresponding half of the outer layer gussets, and the inwardly projecting gusset half will project away from the corresponding other half of outer layer gussets. It will be appreciated that the outer layer gussets are formed in place over the outwardly projecting gusset half of the liner. When the bag is filled with product, the positive pressure in the bag created by the product or by a fluid stream forcing the product into the bag will force the inwardly projecting gusset halves to expand outwardly into nesting relationship with the corresponding other halves of the outer layer gussets. Thus, when the bag is filled, the liner gussets will nest completely within the gussets of the outer layers.

It is, therefore, an object of this invention to provide a multiwall gussetted bag which has a seamless tubular plastic gussetted liner.

It is a further object of this invention to provide a bag of the character described wherein the gussets on the liner are initially formed with outwardly projecting halves adjacent to inwardly projecting halves.

It is an additional object of this invention to provide a bag of the character described which can be formed from periodically perforated stock.

It is another object of this invention to provide a bag of the character described wherein the liner gussets will nest completely with the outer gussets when the bag is filled with product.

These and other objects and advantages of the subject invention will become more readily apparent from the following detailed description of a preferred embodiment of the invention when taken in conjunction with the accompanying drawings in which.

Figure 1:
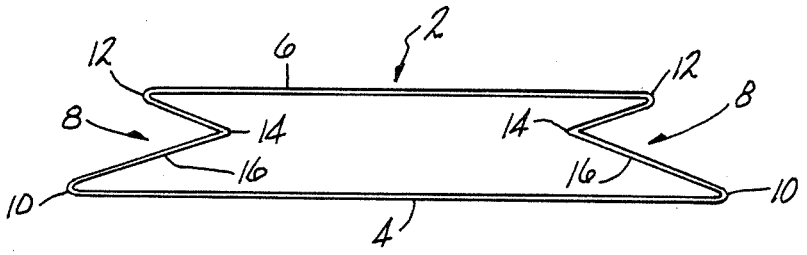
FIG. 1 is an end elevational view of a seamless plastic liner tube which has been gussetted in accordance with this invention.
Figure 2:
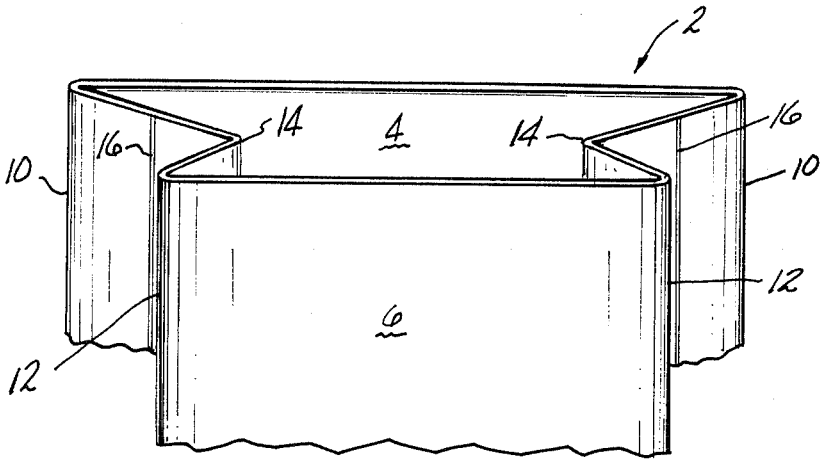
FIG. 2 is a fragmented perspective view of the tube of FIG. 1.

Referring now to the drawings, there is shown in FIGS. 1 and 2 a seamless plastic liner tube which has been gussetted in accordance with this invention. The liner, denoted generally by the numeral 2, is shown in end elevation and is shown slightly expanded for clarity. The liner 2 includes a first wall 4, a second wall 6, and gussetted side walls denoted generally by the numeral 8. Each side wall 8 is connected to the first wall 4 by a longitudinal fold line 10 and is connected to the second wall 6 by a longitudinal fold line 12. Additionally, each side wall 8 is folded about a first internal longitudinal fold line 14. Each side wall 8 is provided with a second internal fold line 16 approximately midway between the fold lines 10 and 14, but the liner 2 is not folded about the fold line 16 as it is fed into the bag-making machine. It will be noted that the gussetted sides 8 of the liner 2 include two outwardly directed pleats formed at the fold lines 10 and 12, and one inwardly directed pleat formed at the fold lines 14 with the pleats at the fold lines 10 being outward of the pleats at the fold lines 12.

Figure 3:
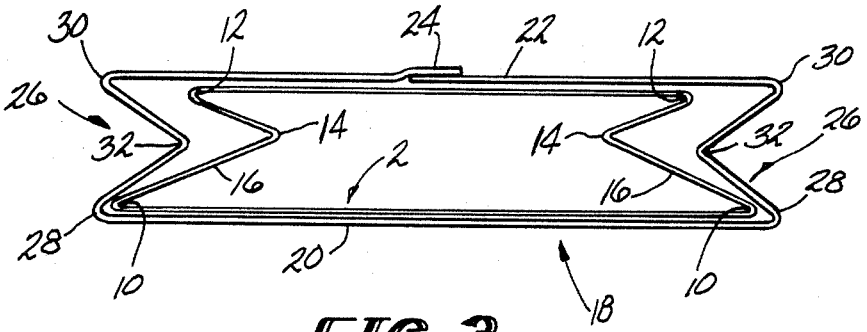
FIG. 3 is a view similar to FIG. 1 but showing one of the outer seamed layers after it has been gussetted and formed outwardly of the liner.

Referring now to FIG. 3, a simplified form of a bag is shown in end elevation. The bag of FIG. 3 has only one outer layer or wall outside of the liner 2, but it will be appreciated that any number of such outer layers can be formed on the bag. The liner 2 is fed into a forming machine in the gussetted form shown in FIGS. 1 and 2 but flattened. The outer layers are then formed around the liner from flat sheets which are gusset scored and seamed around the moving liner 2. The outer layer, denoted generally by the numeral 18, has a front wall 20 and a back wall 22 in which a lap seam 24 is formed. Gussetted side walls 26 interconnect the front and back walls 20 and 22. The side walls 26 are connected to the front wall 20 by fold lines 28 and to the back wall 22 by fold lines 30. A medial fold line 32 bisects each of the side walls 26 of the outer layer 18. It will be noted that the pleats formed by the fold lines 10 in the liner 2 are fully nested in the pleats formed by the fold lines 28 in the outer layer 18. At the same time, the pleats formed by the fold lines 12 in the liner 2 are not at all nested in the pleats formed by the fold lines 30 in the outer layer 18. The fact that the pleats formed at the fold lines 10 lie outside of the pleats formed at the fold lines 12 allows the outer layers to be gussetted about the outer fold lines 10 without regard to the inner fold lines 12. In the form shown in FIG. 3, the fold lines 16 are disposed inwardly adjacent to the fold lines 32 on the outer layer 18.

Figure 4:
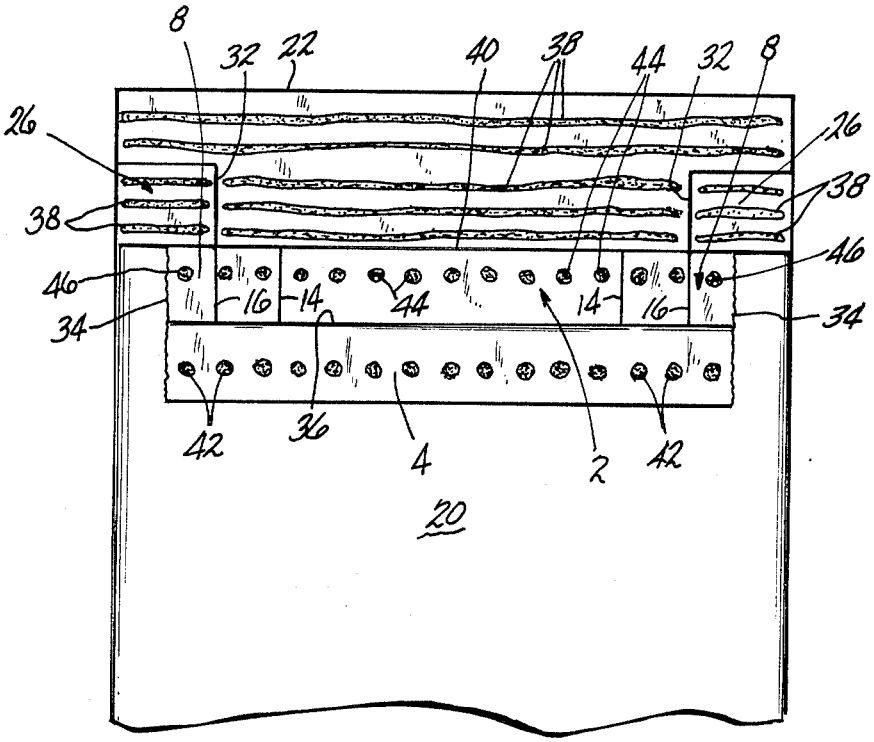
FIG. 4 is a fragmented front elevational view of a multiwall bag formed in accordance with this invention with an upper part of the front wall of the bag being cut and pivoted through a 180° angle for purposes of clarity.

Referring now to FIG. 4, there is shown the upper front portion of an open empty bag formed in accordance with the invention. The front wall 20 of the bag has been cut at 34 and folded down at 36 for purposes of clarifying the internal structure of the bag. It will be noted that the bag has a stepped upper end closure whereby the outer layer back wall 22 extends above the upper edge of the gussetted side walls 26, and the gussetted side walls 26, in turn, extend above the upper edge of the front wall 20. Strips of adhesive 38 are coated across the inside of the back wall 22 and across the gussetted side walls 26. The top edge of the liner 2 is at 40. The wall 4 of the liner 2 is secured to the wall 20 of the outer layer by adhesive spots 42, and the wall 6 of the liner 2 is secured to the wall 22 of the outer layer by adhesive spots 44. The liner side walls 8 are secured to the outer layer side walls 26 by adhesive spots 46. The liner fold lines 16 lie inwardly adjacent to the outer layer fold lines 32, and the liner fold lines 14 lie still further inwardly of the outer layer side walls 26.

Figure 5:
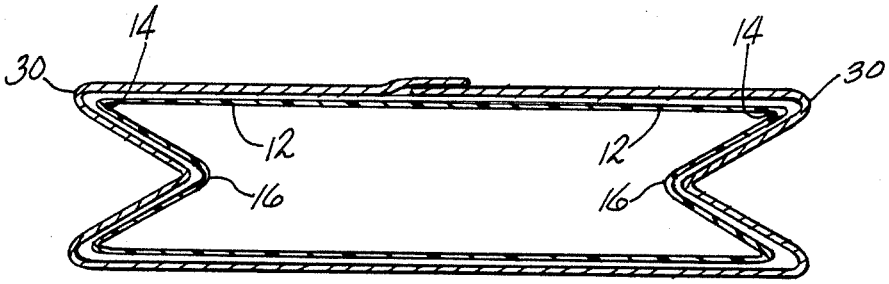
FIG. 5 is a transverse sectional view showing the liner after it has expanded into its full gusset nesting condition during filling of the bag.

When the interior of the bag is subjected to positive pressure, as during the filling operation, either by the product filling the bag, or by the pressure of impelling gas which impels the product into the bag, the pleats formed by the fold lines 14 in the liner 2 will reverse and will nest in the pleats formed by the fold lines 30 in the outer layer, as shown in FIG. 5. When this happens, the fold lines 12 in the liner 2 will straighten, and the liner 2 will bend about the previously straightened fold lines 16. Thus, when the bag is filled with product, the liner gussets will be fully and completely nested in the outer layer gussets.

It will be readily appreciated that multiwall gussetted bags can be made in accordance with this invention with seamless tubular liners. The outer layers can be gussetted and seamed around the liners because of the particular gussetting which is formed on the liner tube. The liners can then be adhesively secured to the outer layers to form a bag, which bag will have conventionally nested gussets once it is filled with a product.

Since many changes and variations of the disclosed emodiment of the invention may be made without departing from the inventive concept, it is not intended to limit the invention otherwise than as required by the appended claims.

What is claimed is:

1. A seamless plastic tubular liner for a multiwall gussetted bag, said liner comprising first and second walls interconnected by gussetted side walls, said gussetted side walls including gussets having a first outwardly directed pleat at an edge of one of said first and second walls, and a second outwardly directed pleat at a corresponding edge of the other of said first and second walls, an inwardly directed pleat between said first and second outwardly directed pleats, said first outwardly directed pleat being disposed outwardly of said second outwardly directed pleat and a longitudinal fold line in each of said side walls interposed between said first outwardly directed pleat and said inwardly directed pleat.

2. A multiwall gussetted bag having a tubular plastic liner and at least one outer layer covering said plastic liner, said outer layer comprising front and back walls interconnected by gussetted side walls, each of said gussetted side walls including a pair of coexistent outwardly directed pleats and an intermediate inwardly directed pleat, and said liner having first and second walls adhesively secured to said front and back walls respectively of said outer layer, said first and second walls being interconnected by gussetted side walls, each of said gussetted side walls of said liner including a pair of marginal outwardly directed pleats and an intermediate inwardly directed pleat, one of said outwardly directed liner pleats being nested within a corresponding one of said outwardly directed outer layer pleats, and the other of said outwardly directed liner pleats being inwardly offset from and in nonnesting relationship with the other of said outwardly directed outer layer pleats.

3. The bag of claim 2 wherein each of said gussetted side walls of said liner includes a longitudinal fold line interposed between said one of said outwardly directed pleats and said inwardly directed pleat, said longitudinal fold line being in close proximity to said inwardly directed pleat in said outer layer side wall gusset.

4. The bag of claim 2 wherein said one of said outwardly directed liner pleats is adhesively secured to said corresponding one of said outwardly directed outer layer pleats and said other of said outwardly directed liner pleats is free of adhesive securement with said other of said outwardly directed outer layer pleats.

5. A multiwall bag comprising an outer layer having a front wall, a back wall, and gussetted side walls, said gussetted side walls each comprising a pair of outwardly directed pleats having an inwardly directed pleat interposed therebetween, and a tubular plastic liner disposed in said outer layer, said liner having a first wall adhesively secured to an internal surface of said outer layer front wall, said first wall being bounded laterally by first outwardly directed pleats formed in said liner, said first outwardly directed liner pleats being spaced laterally apart approximately the same distance as the corresponding pair of outwardly directed outer layer pleats which form the lateral edges of said outer layer front wall, said liner further including a second wall adhesively secured to an inside surface of said outer layer back wall, said second wall being bounded laterally by second outwardly directed pleats formed in said liner, said second outwardly directed pleats being spaced laterally apart approximately the same distance as said outer layer inwardly directed pleats, and said liner having respective inwardly directed pleats which are interposed between corresponding pairs of said first and second outwardly directed liner pleats, said inwardly directed liner pleats being inwardly offset from the corresponding inwardly directed outer layer pleats.

* * * * *